US008943832B2

(12) United States Patent
Uhm et al.

(10) Patent No.: US 8,943,832 B2
(45) Date of Patent: Feb. 3, 2015

(54) FUEL NOZZLE ASSEMBLY FOR USE IN TURBINE ENGINES AND METHODS OF ASSEMBLING SAME

(75) Inventors: Jong Ho Uhm, Simpsonville, SC (US); Thomas Edward Johnson, Greer, SC (US)

(73) Assignee: General Electric Company, Schenectady, NY (US)

( * ) Notice: Subject to any disclaimer, the term of this patent is extended or adjusted under 35 U.S.C. 154(b) by 583 days.

(21) Appl. No.: 13/281,631

(22) Filed: Oct. 26, 2011

(65) Prior Publication Data

US 2013/0104552 A1 May 2, 2013

(51) Int. Cl.

| | |
|---|---|
| ***F02C 1/00*** | (2006.01) |
| ***F23R 3/00*** | (2006.01) |
| ***F23R 3/16*** | (2006.01) |
| ***F23R 3/28*** | (2006.01) |
| ***F23D 14/62*** | (2006.01) |
| ***F23D 14/70*** | (2006.01) |

(52) U.S. Cl.

CPC ..... *F23M 99/005* (2013.01); *F23R 3/002* (2013.01); *F23R 3/16* (2013.01); *F23R 3/286* (2013.01); *F23D 14/62* (2013.01); *F23D 14/70* (2013.01); *F23R 2900/00014* (2013.01); *F23R 2900/00017* (2013.01)

USPC ..... 60/740; 60/737

(58) Field of Classification Search

CPC ..... F23R 3/286

USPC ..... 60/748, 737, 740

See application file for complete search history.

(56) References Cited

U.S. PATENT DOCUMENTS

| | | | | |
|---|---|---|---|---|
| 2,982,099 | A * | 5/1961 | Carlisle et al. | 60/739 |
| 3,788,065 | A * | 1/1974 | Markowski | 60/773 |
| 4,784,600 | A * | 11/1988 | Moreno | 431/9 |
| 5,345,758 | A * | 9/1994 | Bussing | 60/39.38 |
| 5,638,682 | A * | 6/1997 | Joshi et al. | 60/737 |
| 5,822,992 | A * | 10/1998 | Dean | 60/737 |
| 6,082,635 | A * | 7/2000 | Seiner et al. | 239/265.19 |
| 6,360,528 | B1 | 3/2002 | Brausch et al. | |
| 6,532,729 | B2 | 3/2003 | Martens | |
| 7,225,623 | B2 | 6/2007 | Koshoffer | |
| 7,305,817 | B2 | 12/2007 | Blodgett et al. | |
| 7,861,528 | B2 * | 1/2011 | Myers et al. | 60/737 |
| 7,926,285 | B2 | 4/2011 | Tisdale et al. | |
| 8,297,059 | B2 * | 10/2012 | Lacy et al. | 60/772 |
| 8,522,556 | B2 * | 9/2013 | Desai et al. | 60/748 |
| 2002/0026796 | A1 * | 3/2002 | Gutmark et al. | 60/737 |
| 2004/0035114 | A1 * | 2/2004 | Hayashi et al. | 60/737 |
| 2007/0113555 | A1 * | 5/2007 | Carroni | 60/737 |

(Continued)

*Primary Examiner* — Gerald L Sung

(74) *Attorney, Agent, or Firm* — Armstrong Teasdale LLP

(57) ABSTRACT

A fuel nozzle for use with a turbine engine is described herein. The fuel nozzle includes a housing that is coupled to a combustor liner defining a combustion chamber. The housing includes an endwall that at least partially defines the combustion chamber. A plurality of mixing tubes extends through the housing for channeling fuel to the combustion chamber. Each mixing tube of the plurality of mixing tubes includes an inner surface that extends between an inlet portion and an outlet portion. The outlet portion is oriented adjacent the housing endwall. At least one of the plurality of mixing tubes includes a plurality of projections that extend outwardly from the outlet portion. Adjacent projections are spaced a circumferential distance apart such that a groove is defined between each pair of circumferentially-apart projections to facilitate enhanced mixing of fuel in the combustion chamber.

12 Claims, 9 Drawing Sheets

(56) References Cited

U.S. PATENT DOCUMENTS

2010/0180600 A1* 7/2010 Lacy et al. ..... 60/740
2012/0131923 A1* 5/2012 ELKady et al. ..... 60/772
2012/0247110 A1* 10/2012 Clemen ..... 60/737
2012/0297787 A1* 11/2012 Poyyapakkam et al. ..... 60/772
2013/0047619 A1* 2/2013 Boardman et al. ..... 60/748
2014/0144141 A1* 5/2014 Uhm et al. ..... 60/737
2014/0144152 A1* 5/2014 Uhm et al. ..... 60/776

* cited by examiner

FUEL NOZZLE ASSEMBLY FOR USE IN TURBINE ENGINES AND METHODS OF ASSEMBLING SAME

STATEMENT REGARDING FEDERALLY SPONSORED RESEARCH & DEVELOPMENT

This invention was made with Government support under Contract No. DE-FC26-05NT42643, awarded by the Department of Energy. The Government has certain rights in this invention.

BACKGROUND OF THE INVENTION

The subject matter described herein relates generally to turbine engines and more particularly, to fuel nozzle assemblies for use with turbine engines.

At least some known gas turbine engines ignite a fuel-air mixture in a combustor assembly to generate a combustion gas stream that is channeled to a turbine via a hot gas path. Compressed air is delivered to the combustor assembly from a compressor. Known combustor assemblies include a combustor liner that defines a combustion region, and a plurality of fuel nozzle assemblies that facilitate fuel and air delivery to the combustion region. The turbine converts the thermal energy of the combustion gas stream to mechanical energy used to rotate a turbine shaft. The output of the turbine may be used to power a machine, for example, an electric generator or a pump.

At least some known fuel nozzle assemblies include tube assemblies or micro-mixers that facilitate mixing substances, such as diluents, gases, and/or air with fuel to generate a fuel mixture for combustion. Such fuel mixtures may include a hydrogen gas ($H_2$) that is mixed with fuel such that a high hydrogen fuel mixture is channeled to the combustion region. During combustion of fuel mixtures, known combustors may experience flame holding or flashback in which the flame that is intended to be confined within the combustor liner travels upstream towards the fuel nozzle assembly. Such flame holding/flashback events may result in degradation of emissions performance and/or overheating and damage to the fuel nozzle assembly, due to the extremely large thermal load.

In addition, during operation of some known combustor assemblies, combustion of high hydrogen fuel mixtures may form a plurality of eddies adjacent to an outer surface of the fuel nozzle assembly that increase the temperature within the combustion assembly and that induce a screech tone frequency that causes vibrations throughout the combustor assembly and fuel nozzle assembly. The increased internal temperature and vibrations may cause wear and/or may shorten the useful life of the combustor assembly.

BRIEF DESCRIPTION OF THE INVENTION

In one aspect, a fuel nozzle for use with a turbine engine is provided. The fuel nozzle includes a housing that is coupled to a combustor liner defining a combustion chamber. The housing includes an endwall that at least partially defines the combustion chamber. A plurality of mixing tubes extends through the housing for channeling fuel to the combustion chamber. Each mixing tube of the plurality of mixing tubes includes an inner surface that extends between an inlet portion and an outlet portion. The outlet portion is oriented adjacent the housing endwall. At least one of the plurality of mixing tubes includes a plurality of projections that extend outwardly from the outlet portion. Adjacent projections are spaced a circumferential distance apart such that a groove is defined between each pair of circumferentially-apart projections to facilitate enhanced mixing of fuel in the combustion chamber.

In another aspect, a combustor assembly for use with a turbine engine is provided. The combustor assembly includes a casing comprising an air plenum, a combustor liner that is positioned within the casing and defining a combustion chamber therein, and a plurality of fuel nozzles that are coupled to the combustor liner. Each fuel nozzle of the plurality of fuel nozzles includes a housing that is coupled to the combustor liner. The housing includes an endwall that at least partially defines the combustion chamber. A plurality of mixing tubes extends through the housing for channeling fuel to the combustion chamber. Each mixing tube of the plurality of mixing tubes includes an inner surface that extends between an inlet portion and an outlet portion. The outlet portion is oriented adjacent to the housing endwall. At least one of the plurality of mixing tubes includes a plurality of projections that extend outwardly from the outlet portion. Adjacent projections are spaced a circumferential distance apart such that a groove is defined between each pair of circumferentially-apart projections to facilitate enhanced mixing of fuel in the combustion chamber.

In a further aspect, a method of assembling a fuel nozzle for use with a turbine engine is provided. The method includes coupling a housing to a combustor liner defining a combustion chamber. The housing includes an endwall that at least partially defines the combustion chamber. A plurality of mixing tubes is coupled to the housing for channeling fuel to the combustion chamber. Each mixing tube of the plurality of mixing tubes includes an inner surface that extends between an inlet portion and an outlet portion, wherein the outlet portion is positioned adjacent the housing endwall. At least one groove is formed through the outlet portion of at least one mixing tube such that a plurality of circumferentially-spaced projections extend outwardly from the outlet portion to facilitate enhanced mixing of fuel in the combustion chamber.

DETAILED DESCRIPTION OF THE INVENTION

The exemplary methods and systems described herein overcome at least some disadvantages of known fuel nozzle assemblies by providing a fuel nozzle that includes a mixing tube that includes a plurality of projections that extend outwardly from an outlet portion of the mixing tube to facilitate improving mixing of a fuel/air mixture with a cooling fluid in a combustion chamber, and to reduce flame holding/flashback events. Moreover, adjacent projections are circumferentially spaced apart to define a chevron-shaped groove to enhance mixing of fuel and air as compared to known fuel nozzle assemblies, thus increasing the operating efficiency of the turbine engine.

As used herein, the term "cooling fluid" refers to nitrogen, air, fuel, inert gases, or some combination thereof, and/or any other fluid that enables the fuel nozzle to function as described herein. As used herein, the term "upstream" refers to a forward end of a turbine engine, and the term "downstream" refers to an aft end of a turbine engine.

Figure 1:
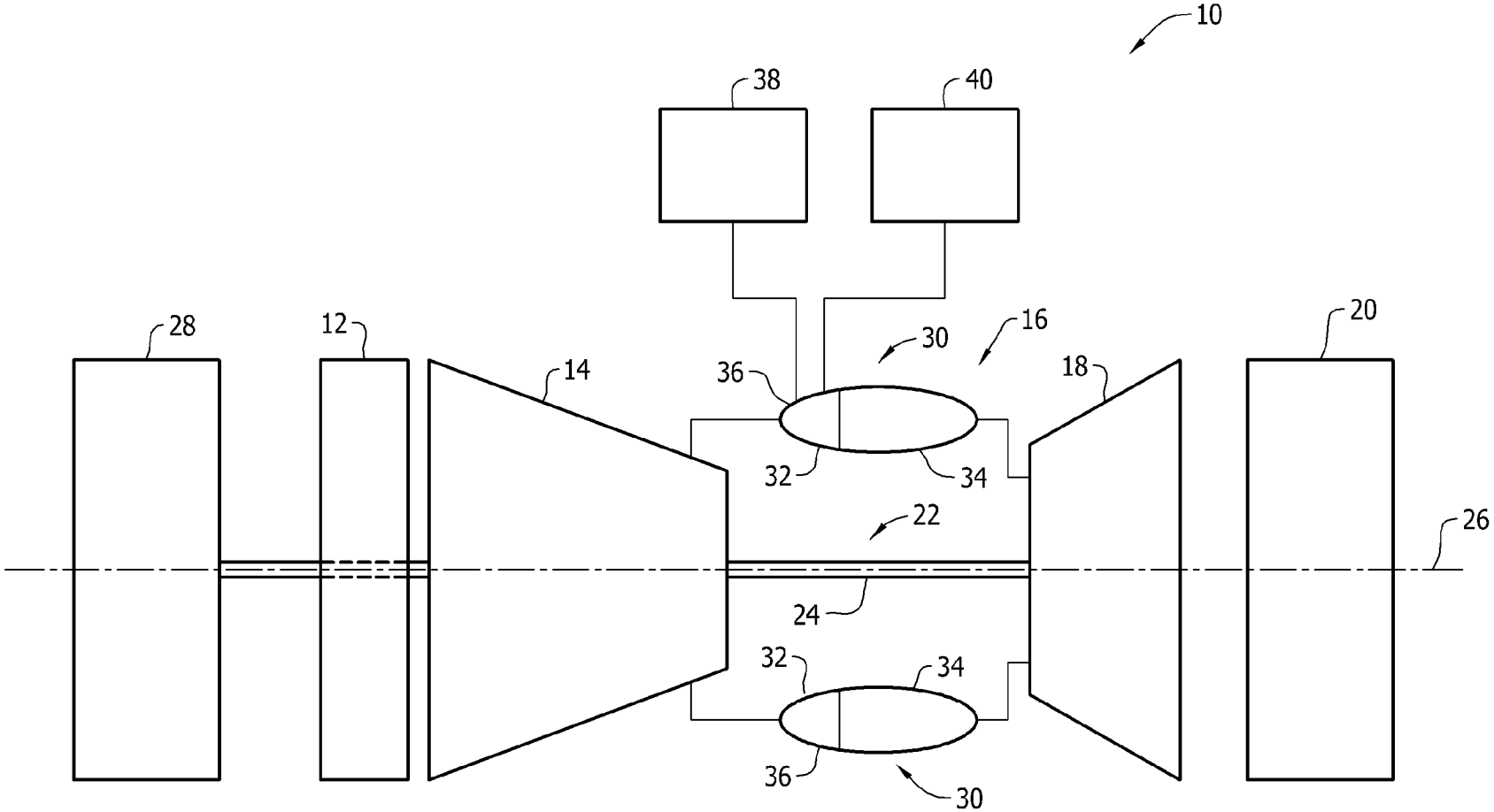
FIG. 1 is a schematic illustration of an exemplary turbine engine.

FIG. 1 is a schematic view of an exemplary turbine engine 10. Turbine engine 10 includes an intake section 12, a compressor section 14 that is downstream from intake section 12, a combustor section 16 downstream from compressor section 14, a turbine section 18 downstream from combustor section 16, and an exhaust section 20 downstream from turbine section 18. Turbine section 18 is coupled to compressor section 14 via a rotor assembly 22 that includes a shaft 24 that extends along a centerline axis 26. Moreover, turbine section 18 is rotatably coupled to compressor section 14 and to a load 28 such as, but not limited to, an electrical generator and/or a mechanical drive application. In the exemplary embodiment, combustor section 16 includes a plurality of combustor assemblies 30 that are each coupled in flow communication with the compressor section 14. Each combustor assembly 30 includes a fuel nozzle assembly 32 that is coupled to a combustion chamber 34. In the exemplary embodiment, each fuel nozzle assembly 32 includes a plurality of fuel nozzles 36 that are coupled to combustion chamber 34 for delivering a fuel-air mixture to combustion chamber 34. A fuel supply system 38 is coupled to each fuel nozzle assembly 32 for channeling a flow of fuel to fuel nozzle assembly 32. In addition, a cooling fluid system 40 is coupled to each fuel nozzle assembly 32 for channeling a flow of cooling fluid to each fuel nozzle assembly 32.

During operation, air flows through compressor section 14 and compressed air is discharged into combustor section 16. Combustor assembly 30 injects fuel, for example, natural gas and/or fuel oil, into the air flow, ignites the fuel-air mixture to expand the fuel-air mixture through combustion, and generates high temperature combustion gases. Combustion gases are discharged from combustor assembly 30 towards turbine section 18 wherein thermal energy in the gases is converted to mechanical rotational energy. Combustion gases impart rotational energy to turbine section 18 and to rotor assembly 22, which subsequently provides rotational power to compressor section 14.

Figure 2:
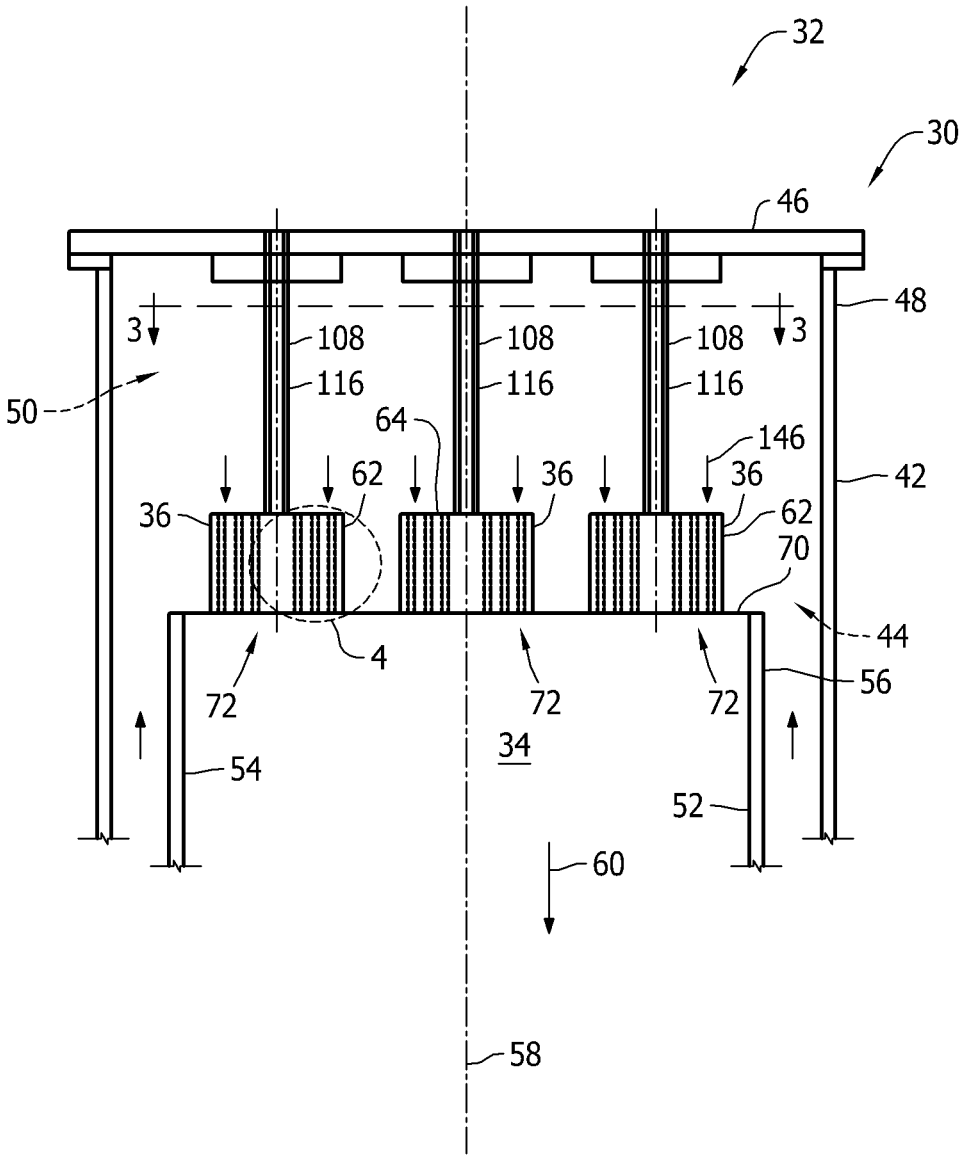
FIG. 2 is a sectional view of an exemplary fuel nozzle assembly that may be used with the turbine engine shown in FIG. 1.
Figure 3:
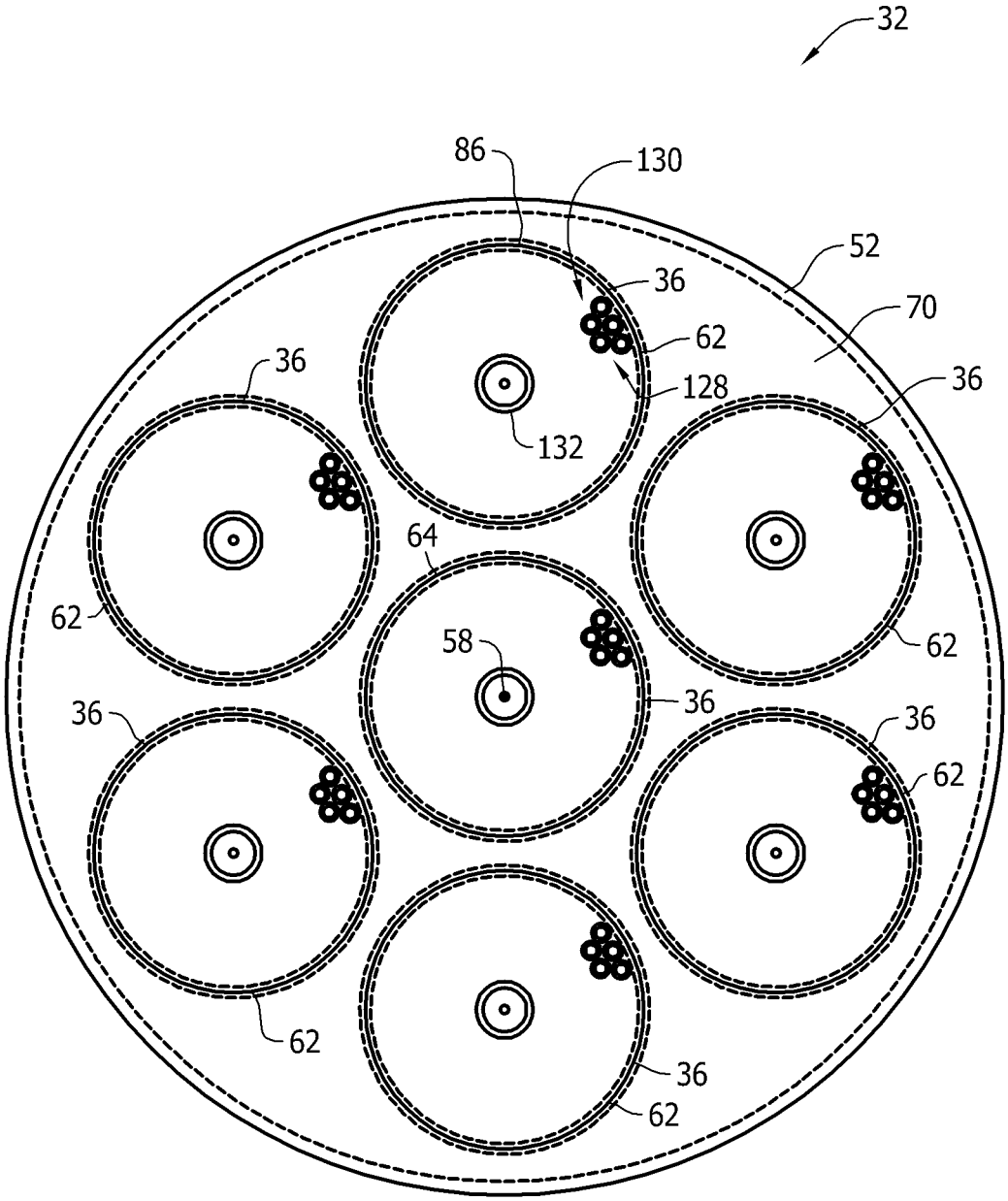
FIG. 3 is a sectional view of a portion of the fuel nozzle assembly shown in FIG. 2 and taken along line 3-3.
Figure 4:
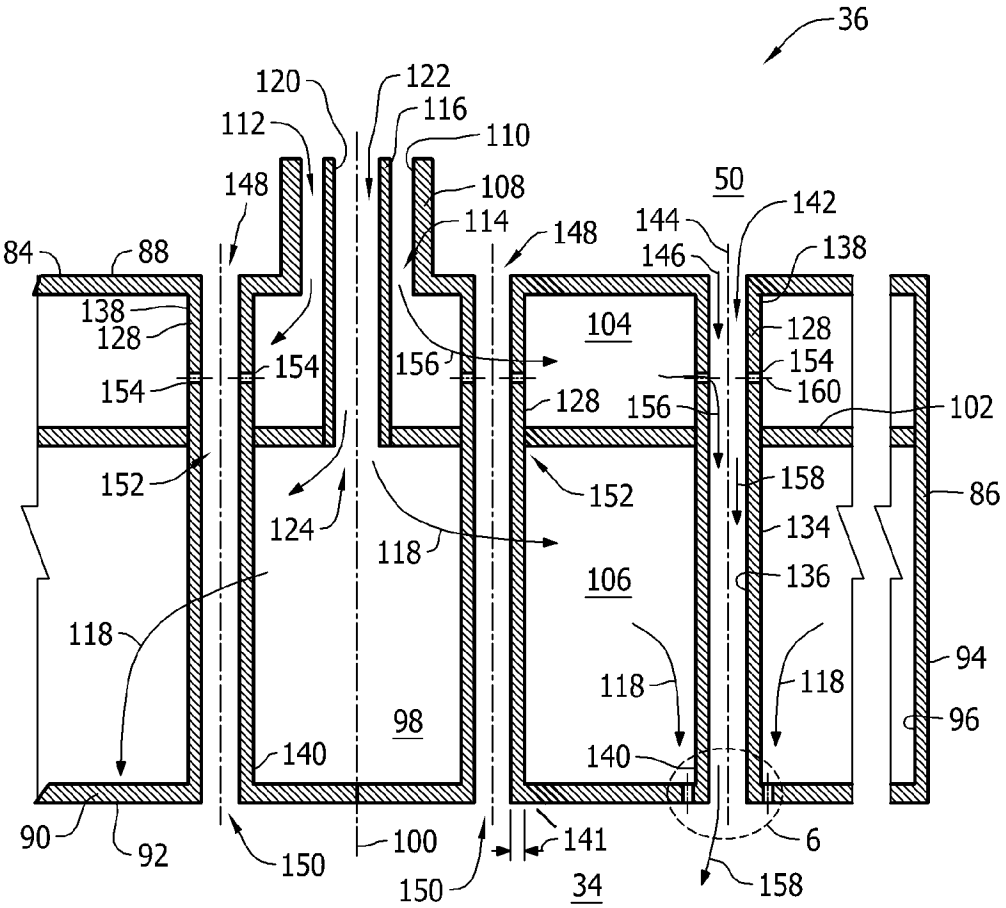
FIG. 4 is an enlarged cross-sectional view of a portion of an exemplary fuel nozzle that may be used with the fuel nozzle assembly shown in FIG. 2 and taken along area 4.

FIG. 2 is a sectional view of an exemplary embodiment of fuel nozzle assembly 32. FIG. 3 is a sectional view of a portion of fuel nozzle assembly 32 taken along line 3-3 in FIG. 2. FIG. 4 is an enlarged cross-sectional view of a portion of fuel nozzle 36 taken along area 4 in FIG. 2. In the exemplary embodiment, combustor assembly 30 includes a casing 42 that defines a chamber 44 within the casing 42. An end cover 46 is coupled to an outer portion 48 of casing 42 such that an air plenum 50 is defined within chamber 44. Compressor section 14 (shown in FIG. 1) is coupled in flow communication with chamber 44 to channel compressed air downstream from compressor section 14 to air plenum 50.

In the exemplary embodiment, each combustor assembly 30 includes a combustor liner 52 that is positioned within chamber 44 and is coupled in flow communication with turbine section 18 (shown in FIG. 1) through a transition piece (not shown) and with compressor section 14. Combustor liner 52 includes a substantially cylindrically-shaped inner surface 54 that extends between an aft portion (not shown) and a forward portion 56. Inner surface 54 defines annular combustion chamber 34 that extends axially along a centerline axis 58, and extends between the aft portion and forward portion 56. Combustor liner 52 is coupled to fuel nozzle assembly 32 such that fuel nozzle assembly 32 channels fuel and air into combustion chamber 34. Combustion chamber 34 defines a combustion gas flow path 60 that extends from fuel nozzle assembly 32 to turbine section 18. In the exemplary embodiment, fuel nozzle assembly 32 receives a flow of air from air plenum 50, receives a flow of fuel from fuel supply system 38, and channels a mixture of fuel/air into combustion chamber 34 for generating combustion gases.

Fuel nozzle assembly 32 includes a plurality of fuel nozzles 36 that are each coupled to combustor liner 52, and at least partially positioned within air plenum 50. In the exemplary embodiment, fuel nozzle assembly 32 includes a plurality of outer nozzles 62 that are circumferentially oriented about a center nozzle 64. Center nozzle 64 is oriented along centerline axis 58.

In the exemplary embodiment, an end plate 70 is coupled to forward portion 56 of combustor liner 52 such that end plate 70 at least partially defines combustion chamber 34. End plate 70 includes a plurality of openings 72 that extend through end plate 70, and are each sized and shaped to receive a fuel nozzle 36 therethrough. Each fuel nozzle 36 is positioned within a corresponding opening 72 such that fuel nozzle 36 is coupled in flow communication with combustion chamber 34.

In the exemplary embodiment, each fuel nozzle 36 includes a housing 84. Housing 84 includes a sidewall 86 that extends between a forward endwall 88 and an opposite aft endwall 90. Aft endwall 90 is oriented between forward endwall 88 and combustion chamber 34, and includes an outer surface 92 that at least partially defines combustion chamber 34. Sidewall 86 includes a radially outer surface 94 and a radially inner surface 96. Radially inner surface 96 defines a substantially cylindrical cavity 98 that extends along a longitudinal axis 100 and between forward endwall 88 and aft endwall 90.

An interior wall 102 is positioned within cavity 98 and extends inwardly from inner surface 96 such that a fuel plenum 104 is defined between interior wall 102 and forward endwall 88, and such that a cooling fluid plenum 106 is defined between interior wall 102 and aft endwall 90. In the exemplary embodiment, interior wall 102 is oriented substantially perpendicularly with respect to sidewall inner surface 96 such that cooling fluid plenum 106 is oriented downstream of fuel plenum 104 along longitudinal axis 100. Alternatively, cooling fluid plenum 106 may be oriented upstream of fuel plenum 104.

In the exemplary embodiment, a plurality of fuel conduits 108 extends between fuel supply system 38 (shown in FIG. 1) and fuel nozzle assembly 32. Each fuel conduit 108 is coupled in flow communication with corresponding fuel nozzle 36. More specifically, fuel conduit 108 is coupled to fuel plenum 104 for channeling a flow of fuel from fuel supply system 38 to fuel plenum 104. Fuel conduit 108 extends between end cover 46 and housing 84 and includes an inner surface 110 that defines a fuel channel 112 within fuel conduit 108 that is coupled to fuel plenum 104. Moreover, fuel conduit 108 is coupled to forward endwall 88 and is oriented with respect to an opening 114 that extends through forward endwall 88 to couple fuel channel 112 to fuel plenum 104.

A plurality of cooling conduits 116 extends between cooling fluid system 40 (shown in FIG. 1) and fuel nozzle assembly 32 for channeling a flow of cooling fluid to fuel nozzle assembly 32. In the exemplary embodiment, each cooling conduit 116 is coupled to a corresponding fuel nozzle 36 for channeling a flow of cooling fluid 118 to cooling fluid plenum 106. Each cooling conduit 116 includes an inner surface 120 that defines a cooling channel 122 that is within cooling conduit 116 and coupled in flow communication with cooling fluid plenum 106.

Cooling conduit 116 is disposed within fuel conduit 108 and extends through fuel plenum 104 to interior wall 102. Cooling conduit 116 is oriented with respect to an opening 124 that extends through interior wall 102 to couple cooling channel 122 in flow communication with cooling fluid plenum 106. In the exemplary embodiment, cooling conduit 116 is configured to channel a flow of cooling fluid 118 into cooling fluid plenum 106 to facilitate cooling aft endwall 90.

In the exemplary embodiment, fuel nozzle 36 includes a plurality of mixing tubes 128 that are each coupled to housing 84. Each mixing tube 128 extends through housing 84 to couple air plenum 50 to combustion chamber 34. Mixing tubes 128 are oriented in a plurality of rows 130 that extend outwardly from a center portion 132 of fuel nozzle assembly 32 towards housing sidewall 86. Each row 130 includes a plurality of mixing tubes 128 that are oriented circumferentially about nozzle center portion 132. Each mixing tube 128 includes an outer surface 134 and a substantially cylindrical inner surface 136, and extends between an inlet portion 138 and an outlet portion 140. Mixing tube 128 includes a width 141 measured between inner surface 136 and outer surface 134. Inner surface 136 defines a flow channel 142 that extends along a centerline axis 144 between inlet portion 138 and outlet portion 140. Inlet portion 138 is sized and shaped to channel a flow of air, represented by arrow 146, from air plenum 50 into flow channel 142 to facilitate mixing fuel and air within flow channel 142.

Forward endwall 88 includes a plurality of inlet openings 148 that extend through forward endwall 88. In addition, aft endwall 90 includes a plurality of outlet openings 150 that extend though aft endwall 90. Each mixing tube inlet portion 138 is oriented adjacent to forward endwall 88 and extends through a corresponding inlet opening 148. Moreover, outlet portion 140 is oriented adjacent to aft endwall 90 and extends through a corresponding outlet opening 150. In addition, each mixing tube 128 extends through a plurality of openings 152 that extend through interior wall 102. In the exemplary embodiment, each mixing tube 128 is oriented substantially parallel with respect to longitudinal axis 100. Alternatively, at least one mixing tube 128 may be oriented obliquely with respect to longitudinal axis 100.

In the exemplary embodiment, one or more mixing tubes 128 include at least one fuel aperture 154 that extends through mixing tube inner surface 136 to couple fuel plenum 104 to flow channel 142. Fuel aperture 154 is configured to channel a flow of fuel, represented by arrow 156, from fuel plenum 104 to flow channel 142 to facilitate mixing fuel 156 with air 146 to form a fuel-air mixture, represented by arrow 158, that is channeled to combustion chamber 34. In the exemplary embodiment, fuel aperture 154 extends along a centerline axis 160 that is oriented substantially perpendicular to flow channel axis 144. Alternatively, fuel aperture 154 may be oriented obliquely with respect to flow channel axis 144.

Figure 5:
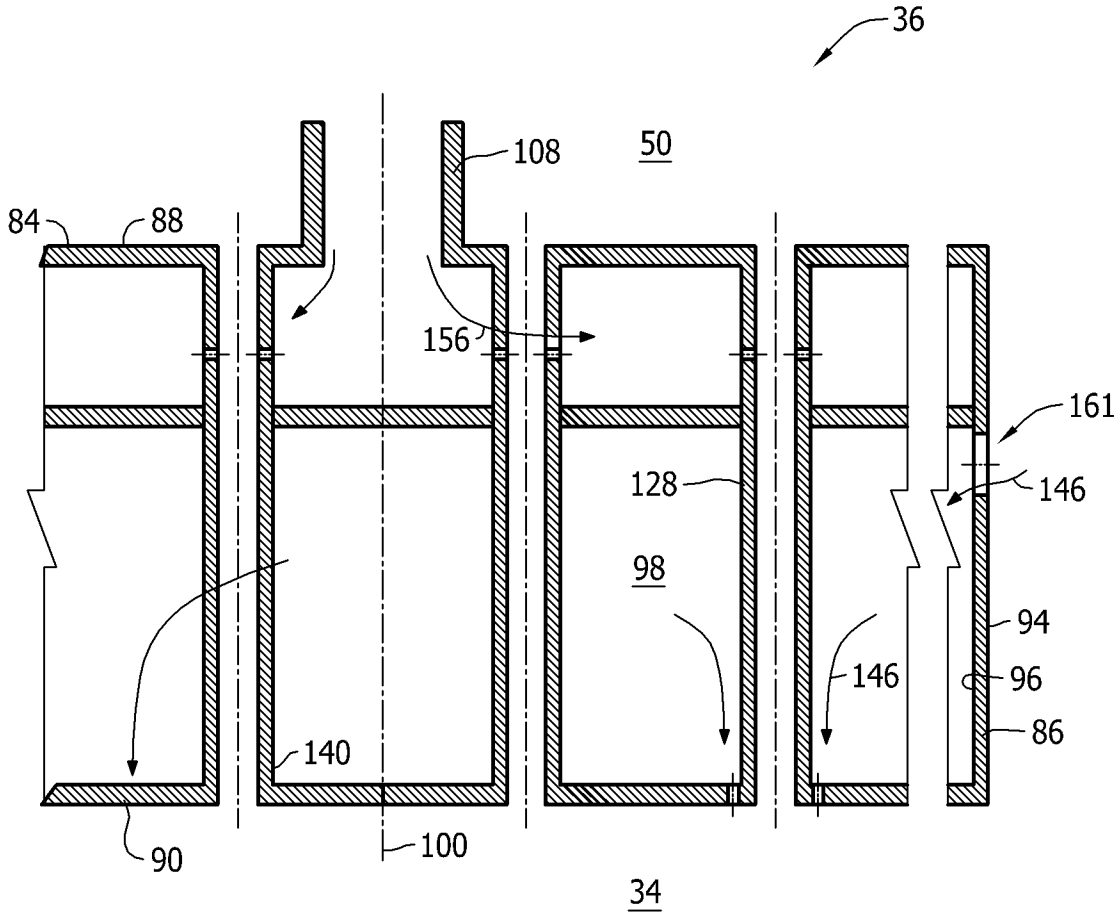
FIG. 5 is an enlarged cross-sectional view of an alternative embodiment of the fuel nozzle shown in FIG. 4.

FIG. 5 is an enlarged cross-sectional view of an alternative embodiment of fuel nozzle 36. In an alternative embodiment, fuel nozzle 36 does not include cooling conduit 116. Sidewall 86 includes an opening 161 that extends through sidewall outer surface 94. Opening 161 is sized and shaped to channel a flow of air from air plenum 50 into cavity 98 to facilitate convective cooling of aft endwall 90.

Figure 6:
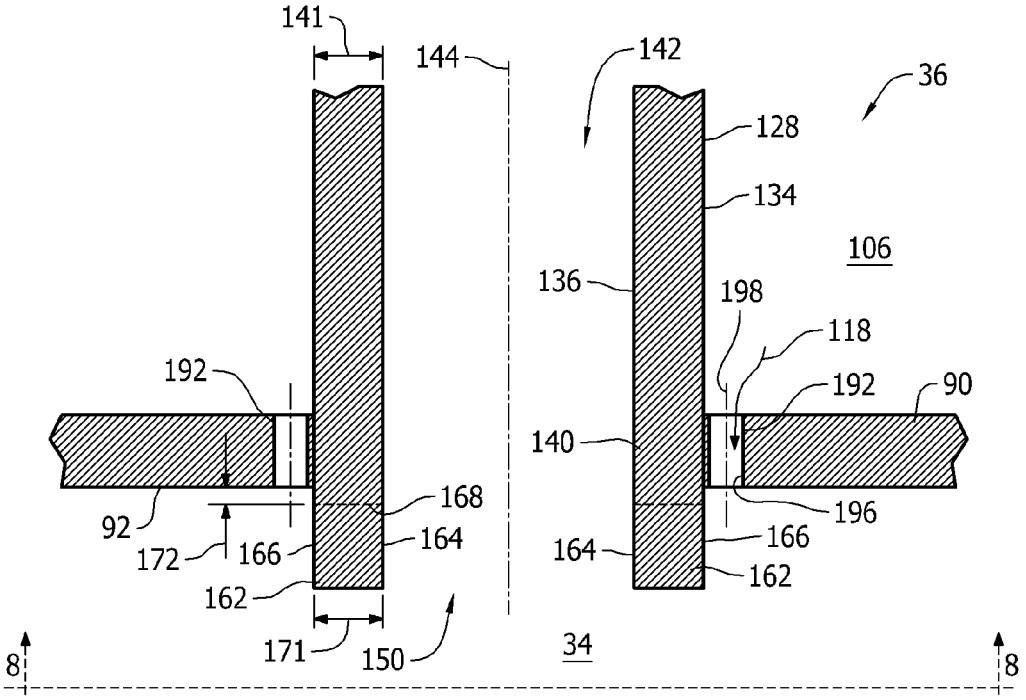
FIG. 6 is an enlarged sectional view of a portion of the fuel nozzle shown in FIG. 4 and taken along area 6.
Figure 7:
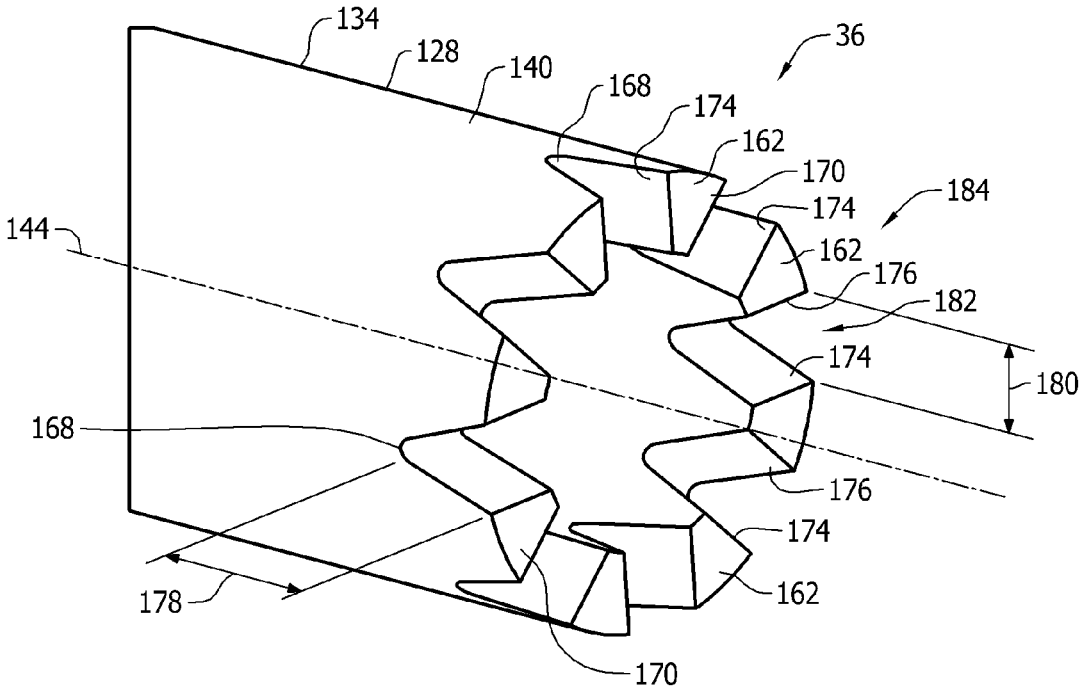
FIG. 7 is a perspective view of a portion of the fuel nozzle shown in FIG. 4.
Figure 8:
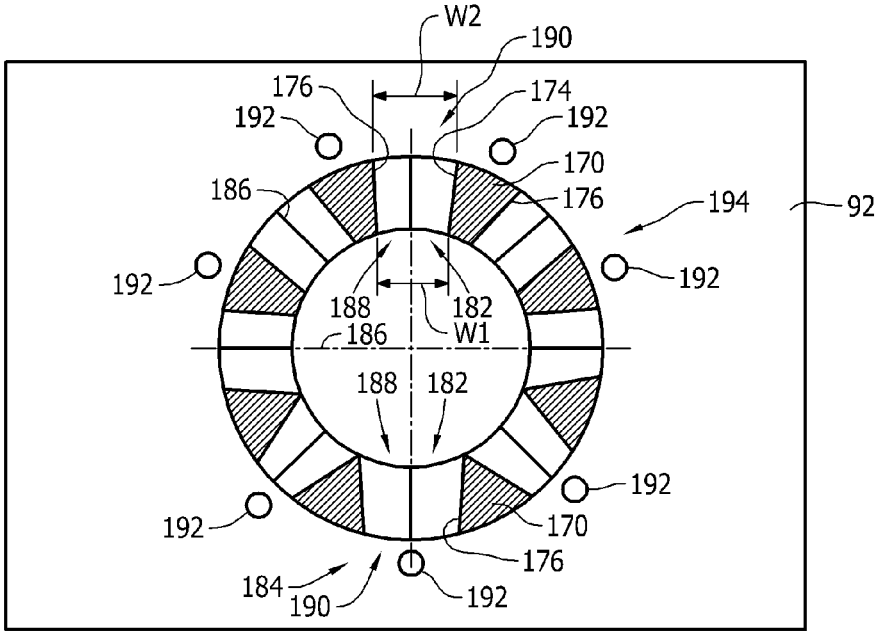
FIG. 8 is a sectional view of a portion of the fuel nozzle shown in FIG. 6 and taken along line 8-8.

FIG. 6 is an enlarged sectional view of a portion of fuel nozzle 36 taken along area 6 shown in FIG. 4. FIG. 7 is a perspective view of a portion of fuel nozzle 36. FIG. 8 is a sectional view of a portion of fuel nozzle 36 taken along line 8-8. Identical components shown in FIGS. 6-8 are identified using the same reference numbers used in FIGS. 2-4. In the exemplary embodiment, at least one mixing tube 128 includes a plurality of projections 162 that extend outwardly from outlet portion 140 and towards combustion chamber 34. Each projection 162 extends radially between a radially inner surface 164 and a radially outer surface 166, and axially between a base portion 168 and a tip surface 170. Each projection 162 includes a width 171 measured between inner surface 164 and outer surface 166. Each projection 162 also extends outwardly from outlet portion 140 such that base portion 168 extends axially for a distance 172 along centerline axis 144 from aft endwall outer surface 92 towards combustion chamber 34. In the exemplary embodiment, projection inner surface 164 is oriented substantially parallel with respect to mixing tube inner surface 136. In addition, projection outer surface 166 is oriented substantially parallel with respect to mixing tube outer surface 134. In the exemplary embodiment, projection width 171 is substantially equal to mixing tube length 141. Alternatively, projection width 171 may be less than, or greater than mixing tube width 141. In addition, at least one projection 162 may include a width 171 that is different than the width of another projection 162.

Moreover, each projection 162 includes a first sidewall 174 and a second sidewall 176. Each sidewall 174 and 176 extends radially between surfaces 164 and 166, and extends along centerline axis 144 between base portion 168 and tip surface 170. In the exemplary embodiment, tip surface 170 is oriented substantially perpendicularly with respect to mixing tube inner surface 136, and extends between sidewalls 174 and 176, and between surfaces 164 and 166. Each sidewall 174 and 176 includes a length 178 measured along centerline axis 144. In the exemplary embodiment, first sidewall 174 and second sidewall 176 are each oriented to converge from outer surface 166 towards inner surface 164 such that tip surface 170 has a substantially trapezoidal shape. Alternatively, sidewalls 174 and 176 may be oriented such that tip surface 170 has a triangular, rectangular, polygonal, or any other suitable shape to enable fuel nozzle assembly 32 to function as described herein.

Each projection 162 is oriented circumferentially about centerline axis 144. In addition, adjacent projections 162 are spaced circumferentially apart for a distance 180 such that a groove 182 is defined between each pair 184 of circumferentially-apart projections 162. More specifically, adjacent circumferentially-spaced projections 162 are oriented such that adjacent sidewalls 174 and 176 at least partially define groove 182.

In the exemplary embodiment, adjacent projections 162 are oriented such that groove 182 has a substantially chevron shape. Moreover, adjacent sidewalls 174 and 176 each extend obliquely from base portion 168 towards tip surface 170, and are oriented to diverge from base portion 168 towards tip surface 170. In addition, groove 182 extends along a centerline axis 186 between an radially inner opening 188 and a radially outer opening 190. Inner opening 188 extends though inner surface 164, and includes a first width $w_1$ measured between adjacent tip surfaces 170. Outer opening 190 extends through outer surface 166 and includes a second width $w_2$ that is measured between adjacent tip surfaces 170. In the exemplary embodiment, adjacent sidewalls 174 and 176 are each oriented such that first width $w_1$ is less than second width $w_2$. Alternatively, adjacent sidewalls 174 and 176 may each be oriented such that first width $w_1$ is larger than, or approximately equal to, second width $w_2$.

In the exemplary embodiment, aft endwall 90 includes a plurality of cooling openings 192 that extend through aft endwall 90 to channel cooling fluid 118 from cooling fluid plenum 106 to combustion chamber 34. Cooling openings 192 are spaced circumferentially about projection outer surface 166 Fuel nozzle assembly 32 includes at least one set 194 of cooling openings 192 that are oriented circumferentially about at least one mixing tube 128. In one embodiment, fuel nozzle assembly 32 includes a plurality of sets 194 of cooling openings 192 that are each oriented with respect to a corresponding mixing tube 128. Each cooling opening 192 is sized and shaped to discharge cooling fluid 118 towards combustion chamber 34 to adjust combustion flow dynamics downstream of endwall outer surface 92 such that secondary mixing of fuel and air through opening 192 and opening 150 occurs to facilitate improving fuel and air mixing, and to reduce an amplitude of screech tone frequency noise generated during operation of combustor assembly 30.

In the exemplary embodiment, each cooling opening 192 includes an inner surface 196 that extends along a centerline axis 198 that is oriented substantially parallel to mixing tube axis 144. In the exemplary embodiment, each cooling opening 192 is oriented with respect to each projection 162 such that each cooling opening 192 is adjacent a corresponding projection outer surface 166. Alternatively, each cooling opening 192 may be oriented with respect to a corresponding groove outer opening 190.

Figure 9:
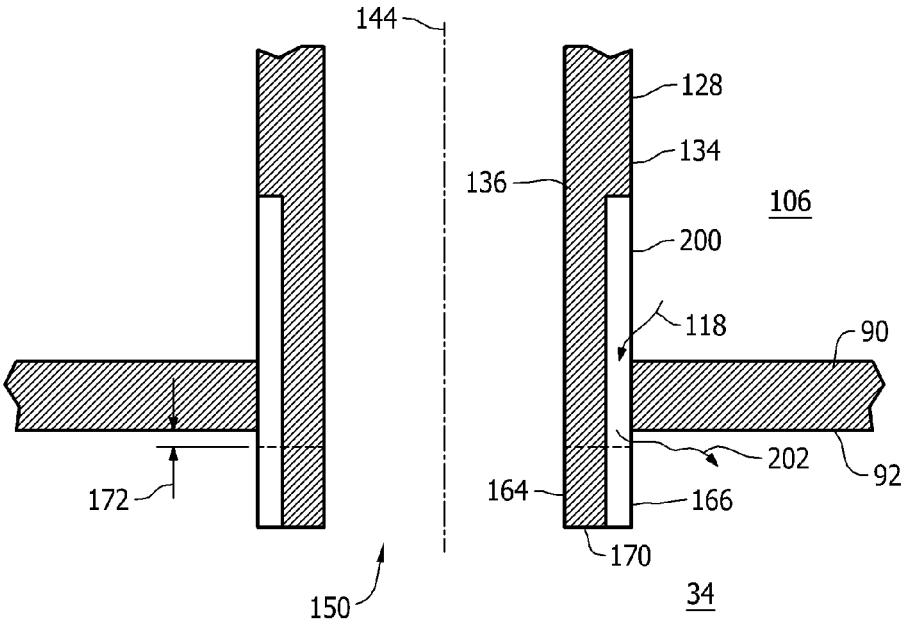
FIGS. 9-12 are enlarged sectional views of alternative embodiments of the fuel nozzle shown in FIG. 6.

FIG. 9-12 are enlarged sectional views of alternative embodiments of fuel nozzle 36. Referring to FIG. 9, in an alternative embodiment, mixing tube 128 includes at least one groove, i.e. a slot 200 that is defined along mixing tube outer surface 134 to couple cooling fluid plenum 106 in flow communication with combustion chamber 34. In the exemplary embodiment, slot 200 extends from mixing tube outer surface 134, across projection outer surface 166, and through tip surface 170. Moreover, slot 200 is sized and shaped to discharge cooling fluid 118 from cooling fluid plenum 106 to combustion chamber 34 to facilitate forming a boundary layer, represented by arrow 202 across aft endwall 90 to adjust combustion flow dynamics downstream of endwall outer surface 92 such that secondary mixing of fuel and air through slot 200 and opening 150 occurs to facilitate improving fuel and air mixing, and to reduce an amplitude of screech tone frequency noise generated during operation of combustor assembly 30. In one embodiment, slot 200 is oriented substantially parallel to mixing tube axis 144. Alternatively, slot 200 may be oriented obliquely with respect to mixing tube axis 144.

Figure 10:
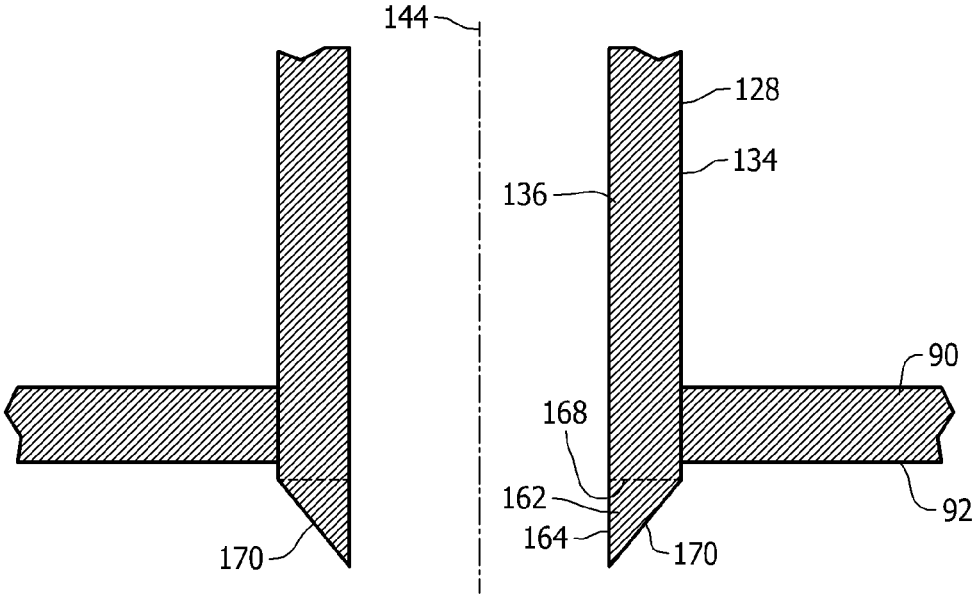
Figure 11:
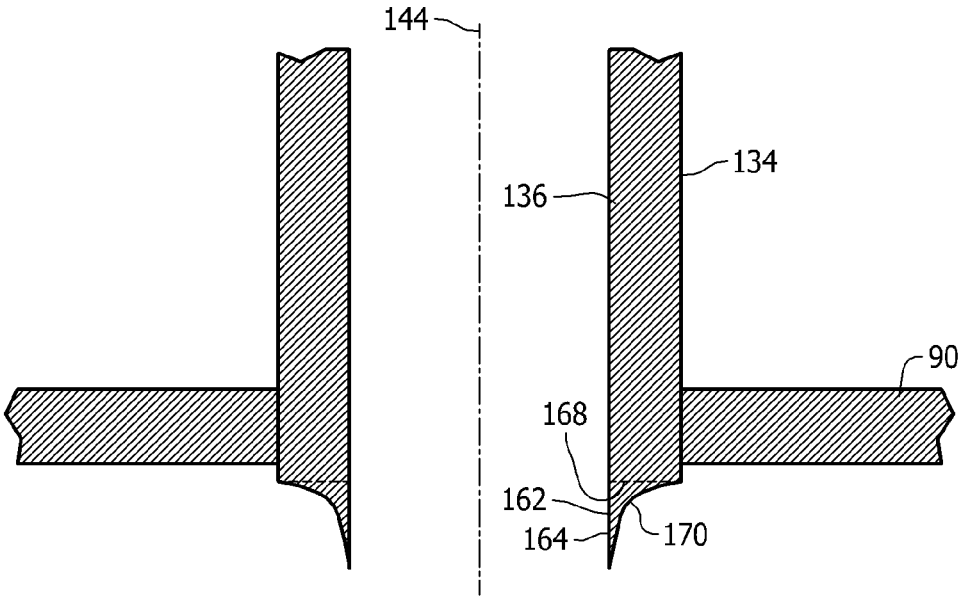
Figure 12:
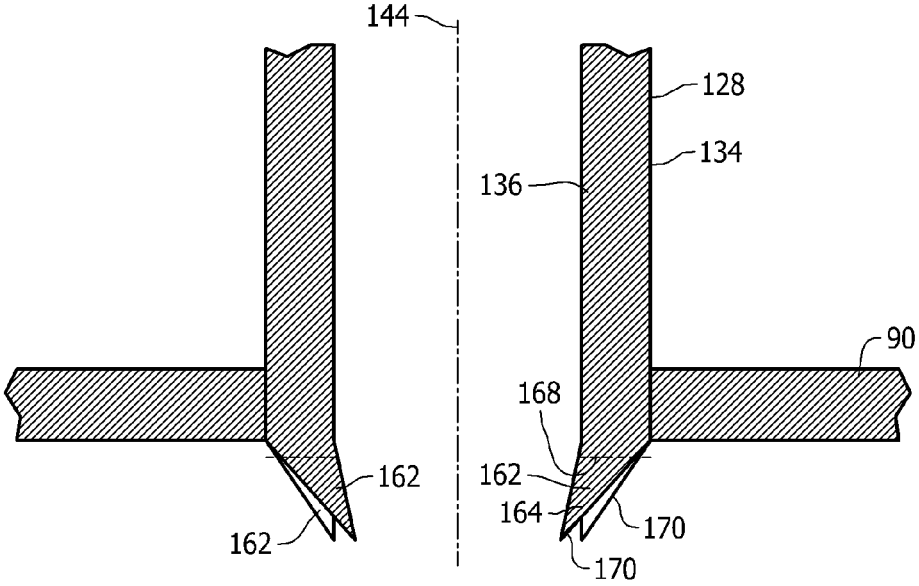

Referring to FIG. 10, in an alternative embodiment, one or more projections 162 include a tip surface 170 that extends obliquely with respect to mixing tube inner surface 136. Referring to FIG. 11, in another embodiment, tip surface 170 includes a substantially arcuate shape. Referring to FIG. 12, in one embodiment, each projection 162 includes a radially inner surface 164 that is oriented obliquely with respect to mixing tube inner surface 136 such that each projection inner surface 164 is oriented to converge from mixing tube outer surface 134 towards centerline axis 144.

The exemplary methods and systems described herein overcome at least some disadvantages of known fuel nozzle assemblies by providing a fuel nozzle that includes a mixing tube that includes a plurality of projections that extend outwardly from an outlet portion of the mixing tube to facilitate improving mixing of a fuel/air mixture with a cooling fluid in a combustion chamber, and to reduce flame holding/flashback events. Moreover, adjacent projections are circumferentially spaced apart to define a chevron-shaped groove to enhance mixing of fuel and air as compared to known fuel nozzle assemblies, thus increasing the operating efficient of the turbine engine.

The size, shape, and orientation of projections 162 are selected to facilitate improving the mixing of fuel and air as compared to known fuel nozzle assemblies. In addition, the size, shape, and orientation of grooves 182 are selected to facilitate adjusting combustion flow dynamics and to facilitate reducing the amplitude of screech tone frequencies that cause undesired vibrations within fuel nozzle assembly 32.

The above-described apparatus and methods overcome at least some disadvantages of known fuel nozzle assemblies by providing a fuel nozzle that includes a plurality of projections that extend outwardly from an outlet portion of a mixing tube to facilitate improving mixing of a fuel/air mixture with a cooling fluid in a combustion chamber, and to reduce flame holding/flashback events and to facilitate reducing screech tone frequencies that induce undesirable vibrations that cause damage to the fuel nozzle assembly. In addition, adjacent projections are circumferentially spaced apart to define a chevron-shaped groove. As such, the cost of maintaining the gas turbine engine system is facilitated to be reduced.

Exemplary embodiments of a fuel nozzle assembly for use in a turbine engine and methods for assembling the same are described above in detail. The methods and apparatus are not limited to the specific embodiments described herein, but rather, components of systems and/or steps of the method may be utilized independently and separately from other components and/or steps described herein. For example, the methods and apparatus may also be used in combination with other combustion systems and methods, and are not limited to practice with only the turbine engine assembly as described herein. Rather, the exemplary embodiment can be implemented and utilized in connection with many other combustion system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fuel nozzle for use with a turbine engine, said fuel nozzle comprising:

a housing coupled to a combustor liner defining a combustion chamber, said housing comprising an endwall that at least partially defines the combustion chamber; and a plurality of mixing tubes extending through said housing for channeling a fuel to the combustion chamber, each mixing tube of said plurality of mixing tubes comprising an inner surface extending between an inlet portion and an outlet portion, wherein a fuel aperture extends through said inner surface proximate said inlet portion and is configured to channel a flow of fuel to said mixing tube said outlet portion oriented adjacent said housing endwall, at least one mixing tube of said plurality of mixing tubes comprising:

a plurality of projections extending outwardly from a distal end of said outlet portion, wherein adjacent said projections are spaced a circumferential distance apart such that a groove is defined between each of said pairs of circumferentially-apart projections to facilitate enhanced mixing of fuel in the combustion chamber, and wherein each projection of said plurality of projections comprises one of the following:

(i) a tip surface substantially perpendicular to said inner surface, the tip surface having a substantially trapezoidal shape;

(ii) a tip surface that extends obliquely between said inner surface and an outer surface of said at least one of said plurality of mixing tubes; and (iii) a tip surface that extends between said inner surface and an outer surface of said at least one of said plurality of mixing tubes and has an arcuate shape.

2. A fuel nozzle in accordance with claim 1, wherein each projection of said plurality of projections is oriented such that said groove includes a substantially chevron shape.

3. A fuel nozzle in accordance with claim 1, wherein said tip surface of each projection is oriented a distance from said endwall towards the combustion chamber.

4. A fuel nozzle in accordance with claim 1, further comprising a plurality of openings extending through said end wall, said plurality of openings oriented circumferentially about said at least one mixing tube, each opening of said plurality of openings configured to channel cooling fluid into the combustion chamber.

5. A combustor assembly for use with a turbine engine, said combustor assembly comprising:

a casing comprising an air plenum;

a combustor liner positioned within said casing and defining a combustion chamber therein; and a plurality of fuel nozzles coupled to said combustor liner, each fuel nozzle of said plurality of fuel nozzles comprising:

a housing coupled to said combustor liner, said housing comprising an endwall that at least partially defines the combustion chamber; and a plurality of mixing tubes extending through said housing for channeling fuel to the combustion chamber, each mixing tube of said plurality of mixing tubes comprising an inner surface extending between an inlet portion and an outlet portion, wherein a fuel aperture extends through said inner surface proximate said inlet portion and is configured to channel a flow of fuel to said mixing tube, said outlet portion oriented adjacent said housing endwall, at least one mixing tube of said plurality of mixing tubes comprising:

a plurality of projections extending outwardly from a distal end of said outlet portion, wherein adjacent said projections are spaced a circumferential distance apart such that a groove is defined between each of said pairs of circumferentially-apart projections to facilitate enhanced mixing of fuel in the combustion chamber, and wherein each projection of said plurality of projections comprises one of the following:

(i) a tip surface substantially perpendicular to said inner surface, the tip surface having a substantially trapezoidal shape;

(ii) a tip surface that extends obliquely between said inner surface and an outer surface of said at least one of said plurality of mixing tubes; and (iii) a tip surface that extends between said inner surface and an outer surface of said at least one of said plurality of mixing tubes and has an arcuate shape.

6. A combustor assembly in accordance with claim 5, wherein each projection of said plurality of projections is oriented such that said groove includes a substantially chevron shape.

7. A combustor assembly in accordance with claim 5, wherein said tip surface oriented a distance from said endwall towards the combustion chamber.

8. A combustor assembly in accordance with claim 5, further comprising a plurality of openings extending through said end wall, said plurality of openings oriented circumferentially about said at least one mixing tube, each opening of said plurality of openings configured to channel cooling fluid into the combustion chamber.

9. A method of assembling a fuel nozzle for use with a turbine engine, said method comprising:

coupling a housing to a combustor liner defining a combustion chamber, the housing including an endwall that at least partially defines the combustion chamber;

coupling a plurality of mixing tubes to the housing for channeling fuel to the combustion chamber, each mixing tube of the plurality of mixing tubes includes an inner surface that extends between an inlet portion and an outlet portion, wherein a fuel aperture extends through said inner surface proximate said inlet portion and is configured to channel a flow of fuel to said mixing tube, and wherein the outlet portion is positioned adjacent the housing endwall;

forming at least one groove through the outlet portion of at least one mixing tube of the plurality of mixing tubes such that a plurality of circumferentially-spaced projections extend outwardly from a distal end of the outlet portion to facilitate enhanced mixing of fuel in the combustion chamber, wherein each projection of said plurality of projections comprises one of the following:

(i) a tip surface substantially perpendicular to said inner surface, the tip surface having a substantially trapezoidal shape;

(ii) a tip surface that extends obliquely between said inner surface and an outer surface of said at least one of said plurality of mixing tubes; and (iii) a tip surface that extends between said inner surface and an outer surface of said at least one of said plurality of mixing tubes and has an arcuate shape.

10. A method in accordance with claim 9, further comprising forming the at least one groove having a substantially chevron shape.

11. A method in accordance with claim 9, further comprising forming the at least one groove and wherein the tip surface is oriented a distance from the housing endwall towards the combustion chamber.

12. A method in accordance with claim 9, further comprising forming a plurality of openings through the aft end wall, wherein the plurality of openings are oriented circumferentially about the at least one mixing tube, each opening of the plurality of openings configured to channel cooling fluid into the combustion chamber.

* * * * *